US008983655B2

(12) United States Patent
Braun et al.

(10) Patent No.: US 8,983,655 B2
(45) Date of Patent: Mar. 17, 2015

(54) AUTOMATED DISPENSING SYSTEM AND METHOD

(75) Inventors: Patrick J. Braun, Pittsburgh, PA (US); Robert S. Snyder, Glenshaw, PA (US)

(73) Assignee: Aesynt Incorporated, Cranberry, PA (US)

( * ) Notice: Subject to any disclaimer, the term of this patent is extended or adjusted under 35 U.S.C. 154(b) by 0 days.

(21) Appl. No.: 13/430,431

(22) Filed: Mar. 26, 2012

(65) Prior Publication Data

US 2013/0248547 A1 Sep. 26, 2013

(51) Int. Cl.
*G06F 17/00* (2006.01)
*B65D 83/04* (2006.01)

(52) U.S. Cl.
CPC ..... *B65D 83/04* (2013.01)
USPC ..... 700/243; 700/242

(58) Field of Classification Search
CPC ..... B65D 83/04
USPC ..... 700/242, 243
See application file for complete search history.

(56) References Cited

U.S. PATENT DOCUMENTS 4,717,042 A 1/1988 McLaughlin
4,785,969 A 11/1988 McLaughlin
4,847,764 A 7/1989 Halvorson
5,014,875 A 5/1991 McLaughlin et al.
5,190,185 A 3/1993 Blechl
5,208,762 A * 5/1993 Charhut et al. ..... 700/216
5,314,243 A 5/1994 McDonald et al.
5,346,297 A 9/1994 Colson, Jr. et al.
5,377,864 A 1/1995 Blechl et al.
5,405,048 A 4/1995 Rogers et al.
5,431,299 A 7/1995 Brewer et al.
5,460,294 A 10/1995 Williams
5,468,110 A 11/1995 McDonald et al.
5,480,062 A 1/1996 Rogers et al.
5,520,450 A 5/1996 Colson, Jr. et al.
5,564,803 A 10/1996 McDonald et al.
5,593,267 A 1/1997 McDonald et al.
5,593,269 A * 1/1997 Bernard, II ..... 414/331.04
5,661,978 A 9/1997 Holmes et al.
D384,578 S 10/1997 Wangu et al.
5,713,485 A 2/1998 Liff et al.
5,716,114 A 2/1998 Holmes et al.
5,745,366 A 4/1998 Higham et al.
5,761,877 A 6/1998 Quandt
5,797,515 A 8/1998 Liff et al.
5,805,456 A 9/1998 Higham et al.
5,842,976 A 12/1998 Williamson
5,878,885 A 3/1999 Wangu et al.
5,880,443 A 3/1999 McDonald et al.
5,883,806 A 3/1999 Meador et al.

(Continued)

*Primary Examiner* — Michael K Collins
(74) *Attorney, Agent, or Firm* — Alston & Bird LLP

(57) ABSTRACT

Automated dispensing systems and mechanisms for queuing output from an automated dispensing system are provided for the dispensing of articles. The automated dispensing system may increase efficiency of the automated dispensing system by reducing cycle time, increasing throughput, and reducing the time required for the unloading process. A system for dispensing articles may include a carousel including a plurality of stations, a plurality of carrier holders, each configured to be received at a respective station, and a robot configured to retrieve a carrier holder from the carousel. The robot may further be configured to move the carrier holder proximate the location of a first article, load the first article onto the carrier holder, and return the carrier holder to a station of the carousel.

20 Claims, 10 Drawing Sheets

(56) References Cited

U.S. PATENT DOCUMENTS

| | | | | |
|---|---|---|---|---|
| 5,893,697 | A | 4/1999 | Zini et al. | |
| 5,905,653 | A | 5/1999 | Higham et al. | |
| 5,912,818 | A | 6/1999 | McGrady et al. | |
| 5,927,540 | A | 7/1999 | Godlewski | |
| 5,940,306 | A | 8/1999 | Gardner et al. | |
| 5,971,593 | A | 10/1999 | McGrady | |
| 6,003,006 | A | 12/1999 | Colella et al. | |
| 6,011,999 | A | 1/2000 | Holmes | |
| 6,021,392 | A | 2/2000 | Lester et al. | |
| 6,039,467 | A | 3/2000 | Holmes | |
| 6,065,819 | A | 5/2000 | Holmes et al. | |
| 6,068,156 | A | 5/2000 | Liff et al. | |
| 6,109,774 | A | 8/2000 | Holmes et al. | |
| 6,112,502 | A | 9/2000 | Frederick et al. | |
| 6,116,461 | A | 9/2000 | Broadfield et al. | |
| 6,151,536 | A | 11/2000 | Arnold et al. | |
| 6,170,230 | B1 | 1/2001 | Chudy et al. | |
| 6,176,392 | B1 | 1/2001 | William et al. | |
| 6,189,727 | B1 | 2/2001 | Shoenfeld | |
| 6,219,587 | B1 * | 4/2001 | Ahlin et al. | 700/233 |
| 6,223,934 | B1 | 5/2001 | Shoenfeld | |
| 6,256,967 | B1 | 7/2001 | Hebron et al. | |
| 6,283,322 | B1 | 9/2001 | Liff et al. | |
| 6,289,656 | B1 | 9/2001 | Wangu et al. | |
| 6,338,007 | B1 | 1/2002 | Broadfield et al. | |
| 6,339,732 | B1 | 1/2002 | Phoon et al. | |
| 6,361,263 | B1 | 3/2002 | Dewey et al. | |
| 6,370,841 | B1 | 4/2002 | Chudy et al. | |
| 6,449,927 | B2 | 9/2002 | Hebron et al. | |
| 6,471,089 | B2 | 10/2002 | Liff et al. | |
| 6,497,342 | B2 | 12/2002 | Zhang et al. | |
| 6,499,270 | B2 | 12/2002 | Peroni et al. | |
| 6,532,399 | B2 | 3/2003 | Mase | |
| 6,564,121 | B1 | 5/2003 | Wallace et al. | |
| 6,581,798 | B2 | 6/2003 | Liff et al. | |
| 6,609,047 | B1 | 8/2003 | Lipps | |
| 6,611,733 | B1 | 8/2003 | De La Huerga | |
| 6,625,952 | B1 | 9/2003 | Chudy et al. | |
| 6,640,159 | B2 | 10/2003 | Holmes et al. | |
| 6,650,964 | B2 | 11/2003 | Spano, Jr. et al. | |
| 6,658,324 | B2 | 12/2003 | Bancroft et al. | |
| 6,671,579 | B2 | 12/2003 | Spano, Jr. et al. | |
| 6,681,149 | B2 * | 1/2004 | William et al. | 700/231 |
| 6,742,671 | B2 | 6/2004 | Hebron et al. | |
| 6,755,931 | B2 | 6/2004 | Vollm et al. | |
| 6,760,643 | B2 | 7/2004 | Lipps | |
| 6,776,304 | B2 | 8/2004 | Liff et al. | |
| 6,785,589 | B2 | 8/2004 | Eggenberger et al. | |
| 6,790,198 | B1 | 9/2004 | White et al. | |
| 6,814,254 | B2 | 11/2004 | Liff et al. | |
| 6,814,255 | B2 | 11/2004 | Liff et al. | |
| 6,847,861 | B2 | 1/2005 | Lunak et al. | |
| 6,874,684 | B1 | 4/2005 | Denenberg et al. | |
| 6,892,780 | B2 | 5/2005 | Vollm et al. | |
| 6,895,304 | B2 | 5/2005 | Spano, Jr. et al. | |
| 6,975,922 | B2 | 12/2005 | Duncan et al. | |
| 6,985,797 | B2 | 1/2006 | Spano, Jr. et al. | |
| 6,996,455 | B2 | 2/2006 | Eggenberger et al. | |
| 7,010,389 | B2 | 3/2006 | Lunak et al. | |
| 7,014,063 | B2 | 3/2006 | Shows et al. | |
| 7,016,766 | B2 | 3/2006 | William et al. | |
| 7,040,504 | B2 | 5/2006 | Broadfield et al. | |
| 7,052,097 | B2 | 5/2006 | Meek, Jr. et al. | |
| 7,072,737 | B2 | 7/2006 | Lunak et al. | |
| 7,072,855 | B1 | 7/2006 | Godlewski et al. | |
| 7,077,286 | B2 | 7/2006 | Shows et al. | |
| 7,085,621 | B2 | 8/2006 | Spano, Jr. et al. | |
| 7,092,796 | B2 | 8/2006 | Vanderveen | |
| 7,093,755 | B2 | 8/2006 | Jordan et al. | |
| 7,100,792 | B2 | 9/2006 | Hunter et al. | |
| 7,103,419 | B2 | 9/2006 | Engleson et al. | |
| 7,111,780 | B2 | 9/2006 | Broussard et al. | |
| 7,139,639 | B2 | 11/2006 | Broussard et al. | |
| 7,150,724 | B2 | 12/2006 | Morris et al. | |
| 7,171,277 | B2 | 1/2007 | Engleson et al. | |
| 7,218,231 | B2 | 5/2007 | Higham | |
| 7,228,198 | B2 | 6/2007 | Vollm et al. | |
| 7,249,688 | B2 | 7/2007 | Hunter et al. | |
| 7,348,884 | B2 | 3/2008 | Higham | |
| 7,417,729 | B2 | 8/2008 | Greenwald | |
| 7,419,133 | B2 | 9/2008 | Clarke et al. | |
| 7,426,425 | B2 | 9/2008 | Meek, Jr. et al. | |
| 7,554,449 | B2 | 6/2009 | Higham | |
| 7,571,024 | B2 | 8/2009 | Duncan et al. | |
| 7,588,167 | B2 | 9/2009 | Hunter et al. | |
| 7,610,115 | B2 * | 10/2009 | Rob et al. | 700/245 |
| 7,673,771 | B2 * | 3/2010 | Bedore et al. | 221/123 |
| 7,748,628 | B2 * | 7/2010 | Greyshock | 235/462.01 |
| 7,783,383 | B2 * | 8/2010 | Eliuk et al. | 700/245 |
| 7,930,066 | B2 * | 4/2011 | Eliuk et al. | 700/245 |
| 8,009,913 | B2 * | 8/2011 | Greyshock | 382/181 |
| 8,036,773 | B2 * | 10/2011 | Braun et al. | 700/215 |
| 2003/0066841 | A1 | 4/2003 | Hebron et al. | |
| 2005/0240305 | A1 * | 10/2005 | Bogash et al. | 700/242 |
| 2007/0265729 | A1 | 11/2007 | Braun et al. | |
| 2008/0300794 | A1 * | 12/2008 | Greyshock | 702/19 |

* cited by examiner

AUTOMATED DISPENSING SYSTEM AND METHOD

BACKGROUND

Automated article dispensing systems are commonly used to retrieve articles from a storage location for dispensing to an operator. Such automated dispensing systems may include package retrieval systems in a warehouse, part retrieval systems in a manufacturing facility, and automated medicine dispensing cabinets, robots, or systems commonly found in healthcare facilities for dispensing medications. Automated dispensing systems provide automated access to stored articles that are retrieved based upon a request from a user or a controller. The automated dispensing systems may operate more quickly than a person performing the same task and may also be more reliable and less error prone.

Although automated dispensing systems may provide faster and more reliable dispensing of articles, methods of improving throughput and reducing cycle time may be desirable to enhance the efficiencies provided by such automated dispensing systems.

Accordingly, there is a need in the art for an improved automated dispensing system and queuing output that increases the efficiency of an automated dispensing system and provides enhanced safeguards against erroneous dispensing.

BRIEF SUMMARY

Automated dispensing systems and mechanisms for queuing output from an automated dispensing system are provided for the dispensing of articles. Embodiments of the automated dispensing system may increase efficiency of the automated dispensing system by reducing cycle time, increasing throughput, and reducing the time required for the unloading process.

An example embodiment of a system for dispensing articles may include a carousel including a plurality of stations, a plurality of carrier holders, each configured to be received at a respective station, and a robot configured to retrieve a carrier holder from the carousel. The robot may further be configured to move the carrier holder proximate the location of a first article, load the first article onto the carrier holder, and return the carrier holder to a station of the carousel. Each of the plurality of carrier holders may include a plurality of carriers, where each carrier may be configured to receive one or more articles. The articles may include medications and each of the carriers may be assigned to a patient. Alternatively or additionally, each of the plurality of carriers may be assigned to a time of day for a patient or one or more medications. Each carrier may be configured to receive a patient identifier. The robot may be configured to load at least two of the plurality of carriers with the first article.

Example embodiments of an automated dispensing system may further include an unload station, where the carousel may be configured to rotate a station into alignment with the unload station for manual unloading of the carrier holder at the station. The unload station may include a plurality of doors, where each of said doors may be configured to align with and provide access to a respective carrier of the carrier holder at the station.

Example embodiments of the present invention may include a method for dispensing articles. The method may include rotating a carousel to position a station of the carousel at a robot retrieval location, retrieving a carrier holder from the station with a robot, moving the carrier holder to the location of a plurality of articles, transferring one of the plurality of articles to the carrier holder, and returning the carrier holder to said station on the carousel. The carrier holder may include at least two carriers, each carrier may be configured to receive articles, and where transferring an article to the carrier holder comprises transferring a first article to a first carrier of the at least two carriers and transferring a second article to a second carrier of the at least two carriers. The first article and the second article may each include a medication and a dose, and the first article and the second article may each include the same medication and the same dose.

Methods may further include rotating the carousel to position the station of the carousel at an unload station, where the article is arranged to be retrieved by an operator at the unload station. Methods may further include rotating the carousel to position the station of the carousel at an unload station, where the unload station includes a door aligned with each of the respective at least two carriers of the carrier holder, and where the first article may be retrieved from the first carrier through the door aligned with the first carrier. Each of the at least two carriers may be associated with a single patient.

Further example embodiments of the present invention may provide a method for dispensing articles including retrieving a first article from a first location to a first carrier, retrieving a second article from a second location to the first carrier, moving the first carrier to a location proximate a carousel, where the carousel includes a carrier holder including a plurality of carriers disposed thereon, and transferring the first article and the second article from the first carrier to at least one of the plurality of carriers of the carrier holder. The first carrier may be disposed on the robot. Transferring the first article and the second article from the first carrier to at least one of the plurality of carriers of the carrier holder may include transferring the first article to a first one of the plurality of carriers of the carrier holder and transferring the second article to a second one of the plurality of carriers of the carrier holder. The first article and the second article may each include the same medication and the same dose. The method may include rotating the carousel to position the carrier holder proximate an unloading station.

Embodiments of the present invention may include a system for retrieving stored articles including a carousel with a plurality of stations, and a plurality of carrier holders, each configured to be received at a respective one of the plurality of stations, where each of the plurality of carrier holders includes at least two carriers configured for receiving articles. The system may further include a robot including a carrier, the robot configured to retrieve a first article from a first location to the carrier, retrieve a second article from a second location to the carrier, move the first article and the second article to a position proximate the carousel, transfer the first article from the carrier to one of the at least two carriers configured for receiving articles, and transfer the second article from the carrier to another of the at least two carriers configured for receiving articles. The system may further include a robot configured to retrieve each of the plurality of carrier holders from the carousel, load each of the at least two carriers with at least one article, and return each of the plurality of carrier holders to the carousel. The system may also include an unload station arranged proximate the carousel, where the unload station includes a door for each of the respective two or more carriers, and where the carousel may rotate to align each respective carrier holder with the unload station. The system of example embodiments may include where each of the two or more carriers is associated with a single patient. A patient identifier identifying the single patient may be loaded onto each respective carrier. Articles loaded onto each respective carrier may be dispensed to a container, and the patient identifier may be dispensed to the container for identifying the patient to which the container is assigned.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
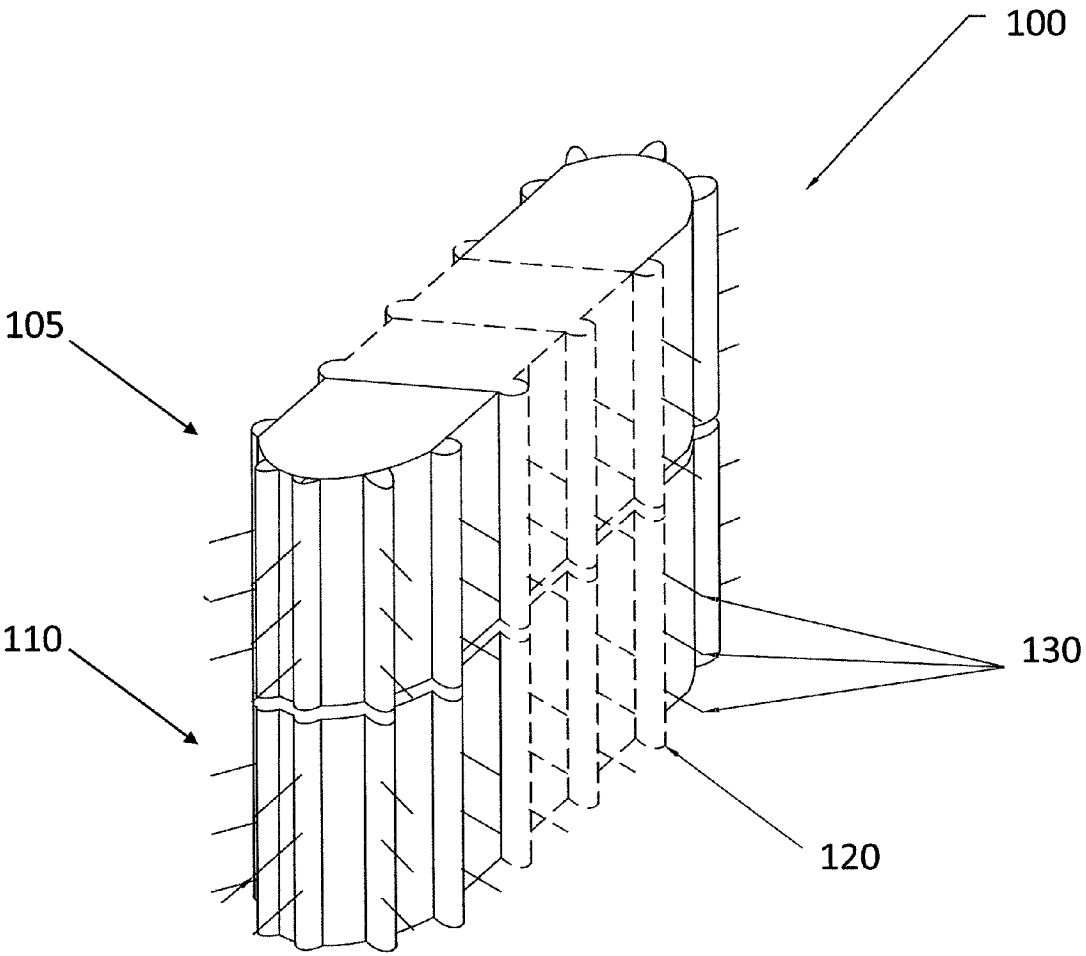
FIG. 1 illustrates an example embodiment of a carousel of an automated dispensing system according to the present invention.

Embodiments of the present inventions now will be described more fully hereinafter with reference to the accompanying drawings, in which some, but not all embodiments of the inventions are shown. Indeed, embodiments of these inventions may be embodied in many different forms and should not be construed as limited to the embodiments set forth herein; rather, these embodiments are provided so that this disclosure will satisfy applicable legal requirements. Like reference numerals refer to like elements throughout.

Automated dispensing systems of embodiments of the present invention may be used in virtually any industry requiring the retrieval of specific articles from a storage location containing a plurality of articles and dispensing of said articles to one or more locations. Such applications may include distribution centers (e.g., an internet shopping shipping facility), manufacturing facilities, and healthcare facilities for retrieval of medications or medical supplies or equipment. While embodiments of the present invention may relate to a variety of industries and applications, example embodiments are generally illustrated and described herein in relation to a healthcare facility.

Example embodiments of the automated dispensing systems of the present invention used by healthcare facilities may be used in facilities such as hospitals, physicians' offices, healthcare clinics, pharmacies, and any other facility that manages and/or dispenses drugs or medical supplies or equipment, particularly when dispensed on a patient-specific basis. The automated dispensing systems and methods described herein provide a streamlined and efficient way for healthcare professionals to interface with an automated storage device to dispense medications. Although nurses, pharmacists, pharmacist assistants, or technicians are often tasked with accessing medication stored in an automated dispensing system, and the example of a generic operator is used in the description that follows, it is understood that the described embodiments apply to any user who is interfacing with the automated dispensing system, including physicians, pharmacists, nurses, laboratory personnel, respiratory therapists, and others.

Furthermore, although the example of an operator interfacing with an automated dispensing system for the purpose of dispensing medications to administer to patients is predominantly described below, one skilled in the art in light of this disclosure would recognize that the embodiments are also applicable to users or operators interfacing with the automated dispensing system for the purpose of restocking medication, taking inventory, and performing other tasks that may require access to the medication stored in the automated dispensing system. In addition, the term "automated dispensing system" is intended to include any type of automated storage or dispensing system or device, including automated dispensing cabinets (ADCs), unit-based cabinets (UBCs), automated dispensing devices (ADDs), automated distribution cabinets, and automated dispensing machines (ADMs), among others.

Automated dispensing systems may be controlled by a controller, such as a computer, that is configured to determine what articles are required to be dispensed, and in what order to dispense the articles. In the embodiment of an automated dispensing system for medications, the controller may be configured to determine the medications required for a particular patient or a plurality of patients and pick those medications from the stored medications. The medications may be picked on a per-patient basis and dispensed to a container for transport to the patient for use.

In an example embodiment of a conventional automated dispensing system, a robot may pick medications for one patient at a time, queue the patient's medications on the robot, such as at an end-of-arm tool (EOAT), and unload the patient's medications to an output system, such as an envelope or bin that is situated in an output queue. In such an embodiment, the robot may need to travel to and from the output queue for every patient. Each patient requires an entire, dedicated cycle of the robot to fill their medication order. In such an example embodiment, the conventional automated dispensing system cannot take advantage of multiple patients with similar medication requirements by, for example, picking multiple doses of a single medication from the same location within the automated dispensing system at the same time. Patients with identical medication requirements each require the same, individual cycle time.

Further, conventional automated dispensing systems may offer a limited output queue in which the medications for a relatively small number of patients may be stored, for example, in envelopes or bins, each assigned to a particular patient. In such an embodiment, the automated dispensing system may require regular and frequent attention from an operator to remove bins or envelopes which have been filled with medication for a patient. The automated dispensing system may also require a storage location in which empty envelopes or bins may be stored in preparation for receiving patient medication.

In the above example embodiment, the cycle time of a robot configured to pick medication for a particular patient may be determined by the average pick time per medication and the average number of medications per patient. At an average of five seconds per pick, and an average of ten picks per patient, the average cycle time for a given patient may be 50 seconds (5 seconds/pick×10 picks/patient=50 seconds/patient). If the output queue is configured to hold ten bins, the pick time to fill the queue is 500 seconds (50 seconds/patient×10 patients), or 8.3 minutes. An operator must be available to unload the output queue approximately every eight minutes in order to minimize the downtime of the automated dispensing system and maximize the duty cycle. In a hospital facility with 500 patients, the automated dispensing system would be picking medication for approximately 7 hours (5 seconds/pick×10 picks/patient×500 patients/3600 seconds/hour=6.94 hours) assuming 100% duty cycle of the robot, which requires unloading of the patient queue every 8.3 minutes. Factoring in the inefficiencies of human operation and the downtime of the robot during the unloading of the output queue, a conventional automated dispensing system requires the constant attention of an operator throughout an entire eight-hour work day or more.

Example embodiments of the present invention aim to reduce cycle time, increase throughput (number of patient doses filled) and reduce the unloading time of an operator. Further, by reducing the frequency of unloading operations, the unloading and operator efficiency may be significantly improved.

Example embodiments of the present invention may implement an improved medication pick process and an improved output queue to reduce cycle time and improve throughput of the automated dispensing system. FIG. 1 illustrates an example embodiment of an output queue of the present invention comprising a carousel 100 including a plurality of carrier holders 120 distributed around the carousel 100 perimeter. The carousel 100 may include one or more levels, such as the two levels (105, 110) depicted in the illustrated embodiment. The carousel may be configured to rotate in order to present a carrier holder at a given location accessible to the robot, as will be described further below. Each level of the carousel may be independently rotatable, or the levels of the carousel may be fixed relative to one another such that they rotate together.

While the output queue is referred to generally as a carousel, the carousel may be a substantially circular carousel, or as in the illustrated embodiment, the carousel may essentially be a continuous conveyor with a conveyor path of any number of possible shapes. For example, a carousel comprising a continuous conveyor may be arranged in an elliptical shape, a round shape, a substantially rectangular shape, a triangular shape, or any shape which may be convenient for incorporation into an existing automated dispensing system enclosure, in an existing facility layout, or in the design of a new automated dispensing system. Additionally, while the illustrated embodiment includes a continuous conveyor carousel, a non-continuous conveyor may also be used; however, such a non-continuous carousel may require bi-directional movement whereas a continuous conveyor may be capable of using a single direction of motion or rotation.

As noted above, a carousel 100 according to example embodiments of the present invention may include a plurality of carrier holders 120 arranged about the perimeter of the carousel 100 and moveable along the path of the carousel. Each of the carrier holders 120 may be individually removable from the carousel 100 and each carrier holder may include at least one carrier 130 disposed on the carrier holders. In the illustrated embodiment, the carrier holders 120 each include three carriers 130. The carriers 130 of each carrier holder 120 may be configured to receive medication transferred from storage locations within the automated dispensing system as outlined further below.

While the illustrated embodiments depict carriers 130 which are rods disposed on carrier holders 120 which are posts, carriers may be embodied as any bin, shelf, tray, rod, clasp, or other mechanism which may be configured to hold or retain an article. Further, the carrier holders may include any mechanism by which one or more of said carriers is attached to the carousel. Further, while the carrier holders of the illustrated embodiments depict three carriers per carrier holder, it is appreciated that any number of carriers may be disposed on a carrier holder according to the size of articles that are to be carried by the carrier. For example, a carrier configured to receive a particularly large medication (e.g., an I.V. bag) may be disposed on a carrier holder including only one carrier while a carrier configured to receive smaller articles (e.g., single blister-pack doses of a medicine) may be disposed on a carrier holder including three or more carriers.

Each carrier 130 may be assigned to a patient or to a patient and a specific time of day for that patient. Each carrier may be configured to receive the medications for a patient or for a patient at a specific time of day. Further, carriers may be permanently affixed or removable from the carrier holders.

Figure 2:
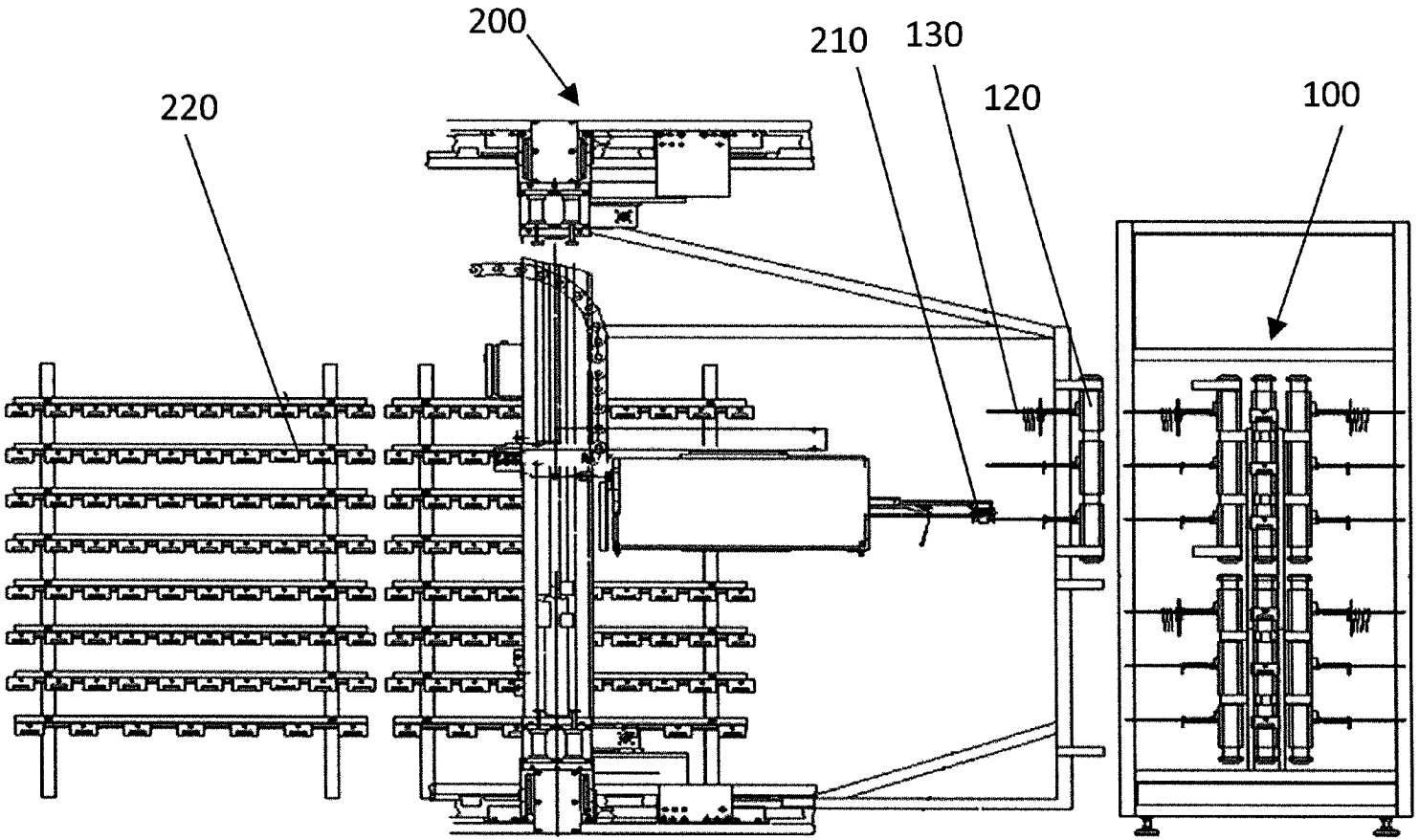
FIG. 2 illustrates an automated dispensing system according to an example embodiment of the present invention.

During operation, a robot of the automated dispensing system may grip and remove a carrier holder 130 from the carousel 100. The robot may be configured with an end-of-arm-tool (EOAT) which is configured to securely hold a carrier holder 120. FIG. 2 illustrates an example embodiment of a robot 200 configured to grip and remove a carrier holder 120 from the carousel 100 using an EOAT 210. Upon removal of the carrier holder 120 from the carousel 100, the robot 200 may move the carrier holder 120 to the location of a medication 220 stored within the automated dispensing system, and transfer the required medication to one or more carriers 130 of the carrier holder 120. As each carrier 130 may be assigned to an individual patient, or to a patient and a time of day for the patient, when the same medication is used for multiple patients or multiple times of day assigned to carriers 130 on the same carrier holder 120, the automated dispensing system of example embodiments may load the required medication on multiple carriers 130, thus reducing the cycle time as compared with loading each carrier independently in sequence. In such an embodiment, the robot cycle time is reduced by taking advantage of filling multiple patient medication orders simultaneously. Each carrier 130 may be configured to hold multiple medications, such as all of the medications for a particular patient or for a particular patient for a time of day. In some cases, medication destined for a patient may not be provided by the automated dispensing system, such as when the medication is of a very large size or if it is an as-needed medication that may be provided through another source (e.g., a mobile medication cart), such that the phrase 'all medication for a patient' as held by a carrier may reference only the medication orders that are to be filled by the automated dispensing system.

Upon filling each carrier 130 of a carrier holder 120 with the required medications, the robot 200 may return the carrier holder 120 to the carousel 100. The carousel may rotate incrementally to present the next available (i.e., empty) carrier holder to the load location for retrieval by the robot 200. Thereupon the robot 200 may remove the next available carrier holder 120 from the carousel. The robot 200 may then load each of the carriers 130 of this carrier holder 120 before returning the carrier holder 120 to the carousel 100. The carrier holder removal, loading of the medication, and return of the carrier holder to the carousel by the robot may continue until all of the carrier holders 120 of the carousel 100 are filled or until the automated dispensing system has filled all medication orders. Upon filling of all orders or filling all of the carrier holders of the carousel, the carousel may be unloaded, as will be described further below.

In another example embodiment of the present invention, the end-of-arm-tool may be configured with multiple carriers configured to receive medications or other articles, and subsequently deliver the medications to the carriers of the carrier holders on the carousel. In such an example embodiment, the carrier holders may not be removed from the carousel in order to load the carriers of the carrier holder with medications. The carrier holders of such an embodiment may or may not be removable from the carousel. Further example embodiments of the invention may include an end-of-arm-tool with a single carrier disposed thereon. The robot may be configured to move the end-of-arm-tool to one or more article locations within the article dispensing system, retrieve a plurality of articles to the single carrier, move the end-of-arm-tool to a carousel, and distribute the retrieved articles to multiple carriers disposed on one or more carrier holders. Such an embodiment may improve article retrieval efficiency by allowing the system to fill the medication orders of multiple patients during a single picking cycle of the robot.

A controller that may be configured to manage the automated dispensing system may receive all of the medication orders for a particular time period and may optimize the received medication orders in order to take advantage of embodiments of the automated dispensing system of the present invention. For example, if a controller receives three medication orders that are identical for three different patients, the controller may group those three medication orders to the same carrier holder, thereby allowing the robot to pick the same medications for each carrier of the carrier holder at each medication location within the automated dispensing system, thereby reducing robot cycle time and optimizing the medication order filling process.

Figure 3:
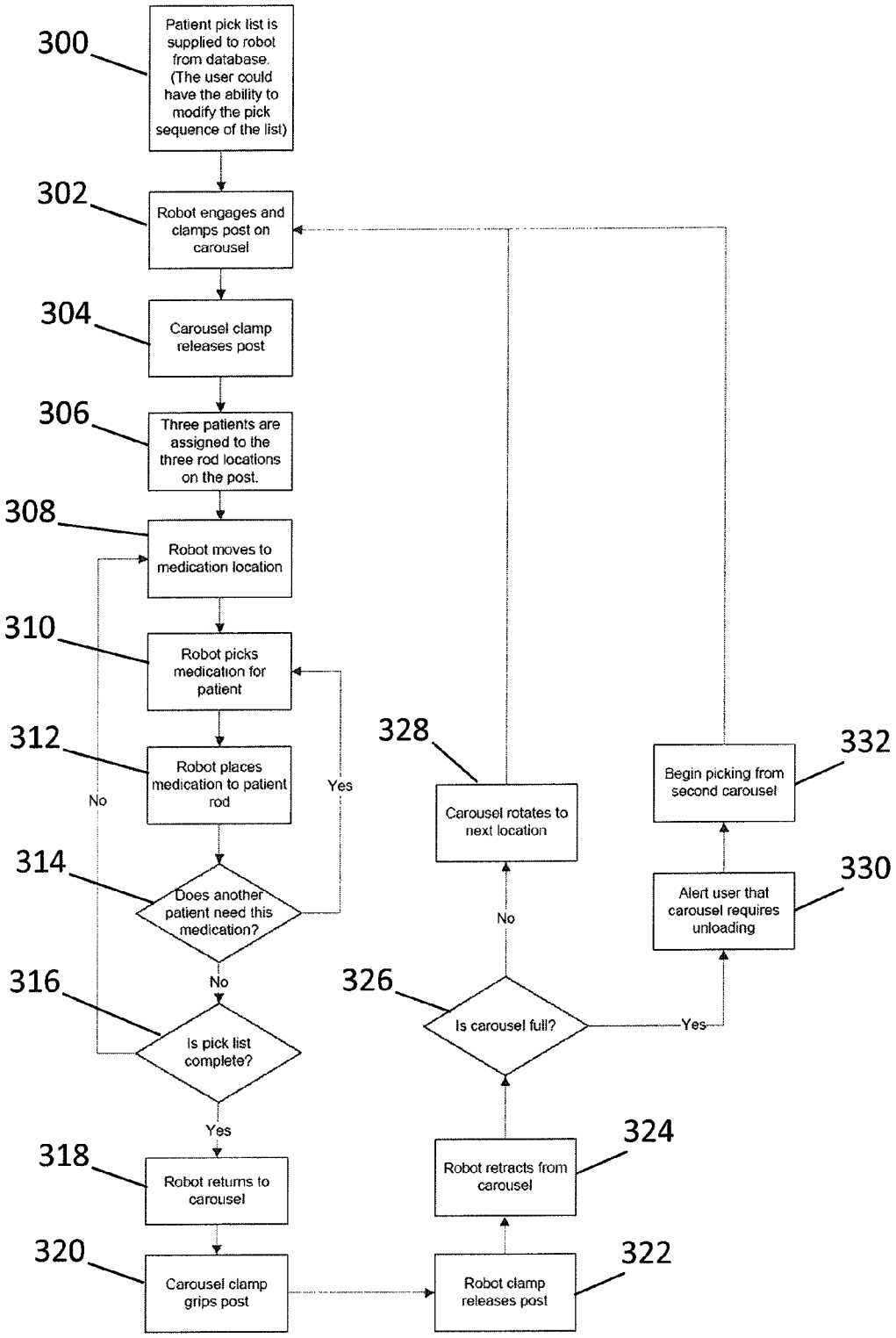
FIG. 3 is a flowchart of a method of operation of an automated dispensing system according to an example embodiment of the present invention.

FIG. 3 illustrates a flow chart of operations of an automated dispensing system according to an example embodiment of the present invention where each carrier of each carrier holder is dedicated to a patient. In the illustrated embodiment, a patient pick list or medication order for a patient is supplied to the robot from a database at 300. The medication order may be provided to the controller in batches (e.g., groups of medication orders) or the medication orders may be provided to the controller as they are entered by a nurse or doctor. The controller may then cause the robot to begin picking a specific medication order. The operator may have the ability to adjust or modify the medication order sequence to accommodate anomalies or to expedite particular medication orders. At 302, the robot engages and clamps on a carrier holder using the EOAT. A carousel clamp holding the carrier holder may be released at 304. Optionally, each carrier holder may be configured to automatically unlock from the carousel or the mechanism by which the carrier holder is secured to the carousel may not require locking and unlocking. At 306, a patient may be assigned to each carrier of the carrier holder (e.g., three patients for a carrier holder with three carriers). At 308, the robot may move to a medication location where the medication is one of the medications on the medication order for one or more patients. At 310, the robot may pick the medication from the storage location within the automated dispensing system. At 312, the robot may place the medication on the appropriate carrier. The controller may then determine if another patient assigned to one of the other carriers of the carrier holder requires the same medication at 314. If another patient requires the medication, the medication may be picked again at 310 and placed on the appropriate patient carrier at 312. In some embodiments, the robot may pick multiple medications at one time and place each of them on the appropriate carrier.

Upon completing the picking of a particular medication, at 314, the controller may then determine if the medication order is complete at 316. If the medication order is not complete, the robot may move to the next medication location at 308 and cycle through the picking process for that medication at operations 310 through 314. If the medication orders are complete for the carrier holder, the robot may then return to the carousel at 318. The robot may place the carrier holder on the carousel at 320 and release the carrier holder at 322 such that the carrier holder is secured to the carousel. The robot may then retract from the carousel at 324. If the carousel is not yet full and the medication orders are not yet complete, the carousel may then rotate to the next available carrier holder at 328 to present the carrier holder to the robot for filling the medication orders of the patients assigned to the carriers of that carrier holder through operations 302 through 324. If the carousel is full or if all medication orders have been completed, the operator may be alerted at 330 that the carousel requires unloading. At this point, the medication orders associated with a second carousel, or second level of the first carousel may be filled through the operations of 302 through 324.

In an example embodiment with a carousel level containing 26 carrier holders, each including three carriers, totaling 78 carriers, the cycle time to fill the 78 medication orders may be 65 minutes (5 seconds/pick×10 picks/patient×78 patients/60 seconds/minute=65 minutes).

Figure 4B:
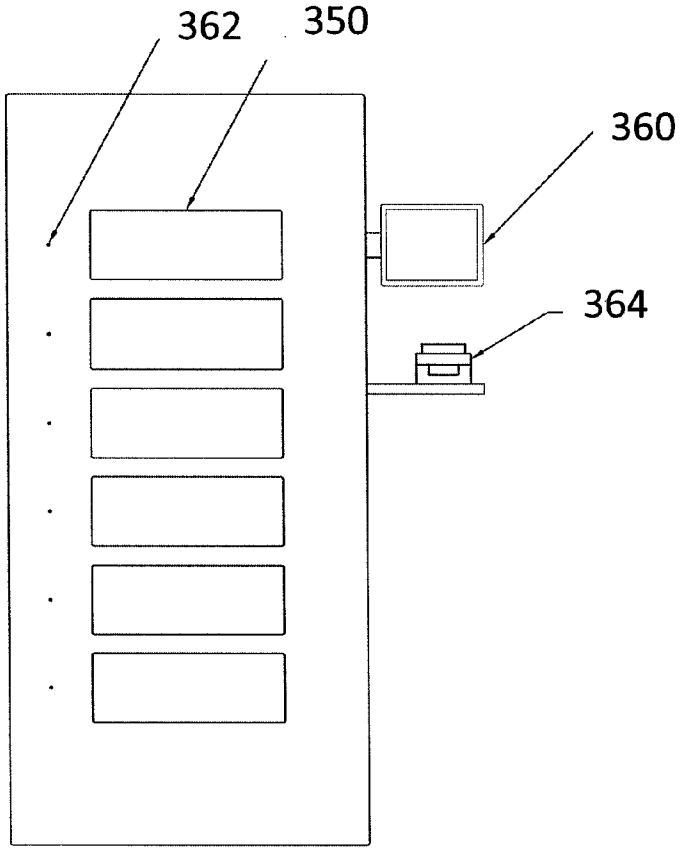
FIG. 4B illustrates an end view of an unloading station of an automated dispensing system according to the example embodiment of FIG. 4A.
Figure 4A:
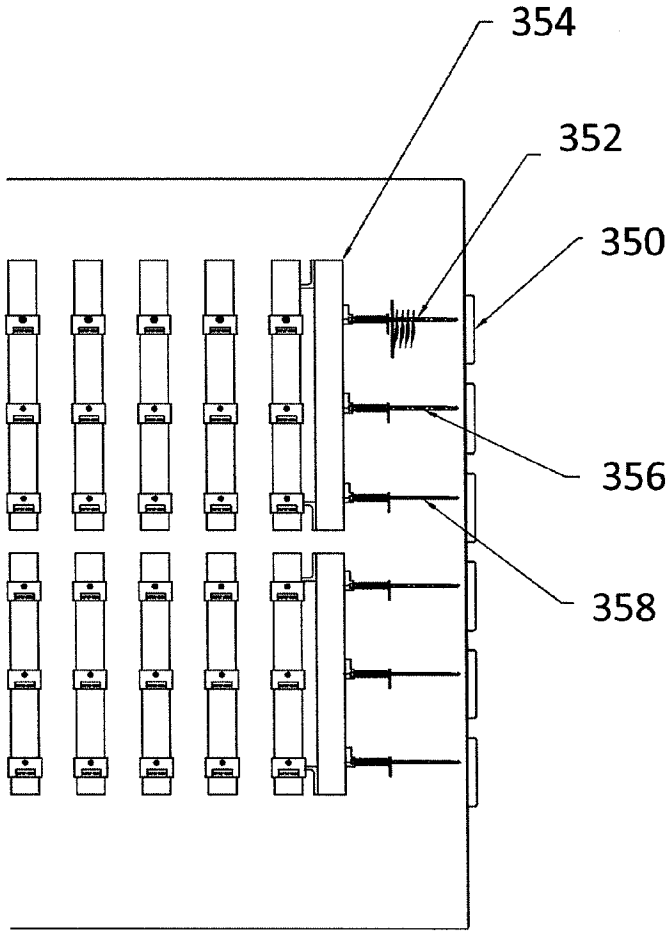
FIG. 4A illustrates a cross-section of an unloading station of an automated dispensing system according to an example embodiment of the present invention.

Example embodiments of automated dispensing systems according to the present invention may include an unloading station proximate the carousel from which an operator can unload the carriers of each carrier holder of the carousel. The operator may unload each patient's medication into a separate container for delivery to the appropriate patient. In order to minimize errors, such as mixing patient medication or selecting improper medication for a patient, the unload station of example embodiments may be configured with a separate door arranged to provide access to each carrier of a carrier holder as illustrated in FIGS. 4A and 4B. FIG. 4A depicts a cross-section of an unloading station according to an example embodiment of the present invention while FIG. 4B illustrates a front view of the unloading station of FIG. 4A. The illustrated embodiment shows a door 350 configured to provide access to carrier 352 of carrier holder 354, but to prevent or otherwise make difficult, access to other carriers 356, 358 of the carrier holder 354. Each door may be separately unlocked by a controller to reduce potential errors during the unloading process. The unlocked door may be indicated by a light (e.g., a light emitting diode) 362 or other indicator as necessary. A screen 360 may be configured to present patient information corresponding to the door that is unlocked, thereby informing the operator of the appropriate patient to which the medication being unloaded is intended. A printer 364 may also be configured to print a label corresponding to the patient for which the medication is intended. This label may include patient information, room information, and medication information. The label may be affixed to the container into which the medication is unloaded, thereby providing routing information for the medication.

Figure 5:
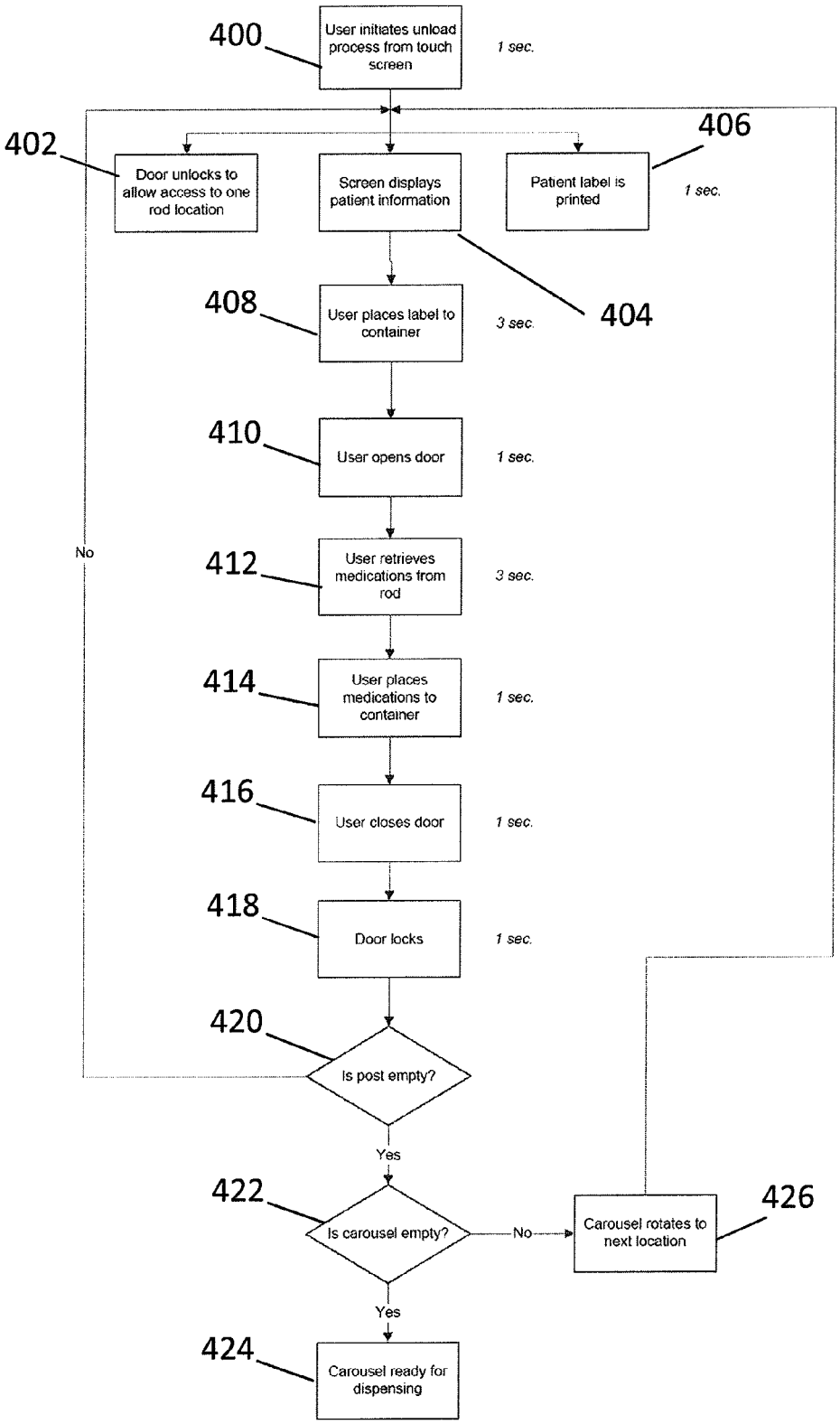
FIG. 5 is a flowchart of a method of unloading an automated dispensing system according to an example embodiment of the present invention.

The unloading process according to an example embodiments is outlined through the flowchart of FIG. 5, which begins with the operator initiating the unload process at 400, at which point a door unlocks to provide access to a single carrier at 402. A screen may display patient information corresponding to the accessible carrier at 404. A patient label may be printed at 406 corresponding to the patient. At 408, the label may be affixed by the operator to a container. The operator may open the unlocked door at 410 and retrieve the medications from the carrier accessible through that door at 412. At 414 the operator may place the unloaded medication in the container that was previously labeled. The operator may then close the door at 416 and the door may lock at 418. While not specifically shown, example embodiments of automated dispensing systems according to the present invention may be configured with a mechanism by which the carrier is checked to verify that it was completely unloaded at operation 412.

At operation 420, the controller may determine whether the carrier holder is empty (i.e., determine if all of the carriers that contained medication have been unloaded). If the carrier holder is not empty, the next door may be unlocked at 402, the next patient information may be displayed at 404, and the next label may be printed at 406. The unloading sequence for that carrier may then be performed in operations 408 through 418. Once the carrier holder is determined to be empty at operation 420, the controller may determine if the carousel is empty at 422. If the carousel is not empty, the carousel may be rotated to the next carrier holder containing medication for unloading of all of the carriers on that carrier holder at 426. If the carousel is empty, the carousel is then available to be loaded with new medication orders by the robot at 424.

The flowchart of FIG. 5 describes operations including operator interaction, the duration of which may be variable depending upon the efficiency of the operator. Assuming an operator that is 85% efficient, the operator may unload the medications from the carriers of the carousel of an example embodiment in approximately 19 minutes (12 seconds/carrier×78 carriers/carousel/60 seconds/minute=19.2 minutes). In such a scenario, the total operator time to unload medications for a 500 patient hospital would be approximately 2 hours (19.2 minutes/carousel×1 carousel/78 patients×500 patients=2 hours, 5 minutes). This compares with the required operator time of 7 hours using the conventional automated dispensing system, thus saving the operator 5 hours and being 350% more efficient.

While the unloading station has been described with respect to a manual unloading process, automation of the unloading station may further enhance the autonomy of an automated dispensing system according to embodiments of the present invention. In such an automated unloading station, the individual doors for each carrier may or may not be necessary as an unloading apparatus may be configured to accurately and repeatably unload each carrier into an envelope, bin, or other container more accurately than by manual interaction. An automated unloading apparatus may include a device such as an arm configured to move the contents of a carrier into a receptacle in response to the receptacle being placed proximate the carrier. In such an embodiment, the receptacles may be disposed on a conveyor or other device in which they are placed in a loading location for reception of the contents of a carrier. The receptacles may be handled thereafter in the same manner in which they are handled during the manual unloading process. Optionally, a carrier holder may be removed from the carousel and used as the conveyance for the contents of each carrier to a patient. For example, if a carrier holder included three carriers, one for morning, mid-day, and evening for a patient, the carrier holder may be removed from the carousel and transported to the location of the patient in order to have the patient's entire days medication available without requiring individual unloading of each carrier to a receptacle.

Medications that go unused after distribution may be returned to the automated dispensing device for replenishing to the storage locations. As the robot of example embodiments interfaces with carrier holders and carriers of the carousel, the robot may substantially reverse the dispensing procedure to replenish returned medications to their respective storage locations. In such an embodiment, the unload station may be used to load returned medications to a carrier holder. A barcode for the medication may be read at the unload station, a door providing access to an empty carrier may be unlocked, and the medication may be loaded onto the carrier for return to the appropriate storage location.

Figure 6:
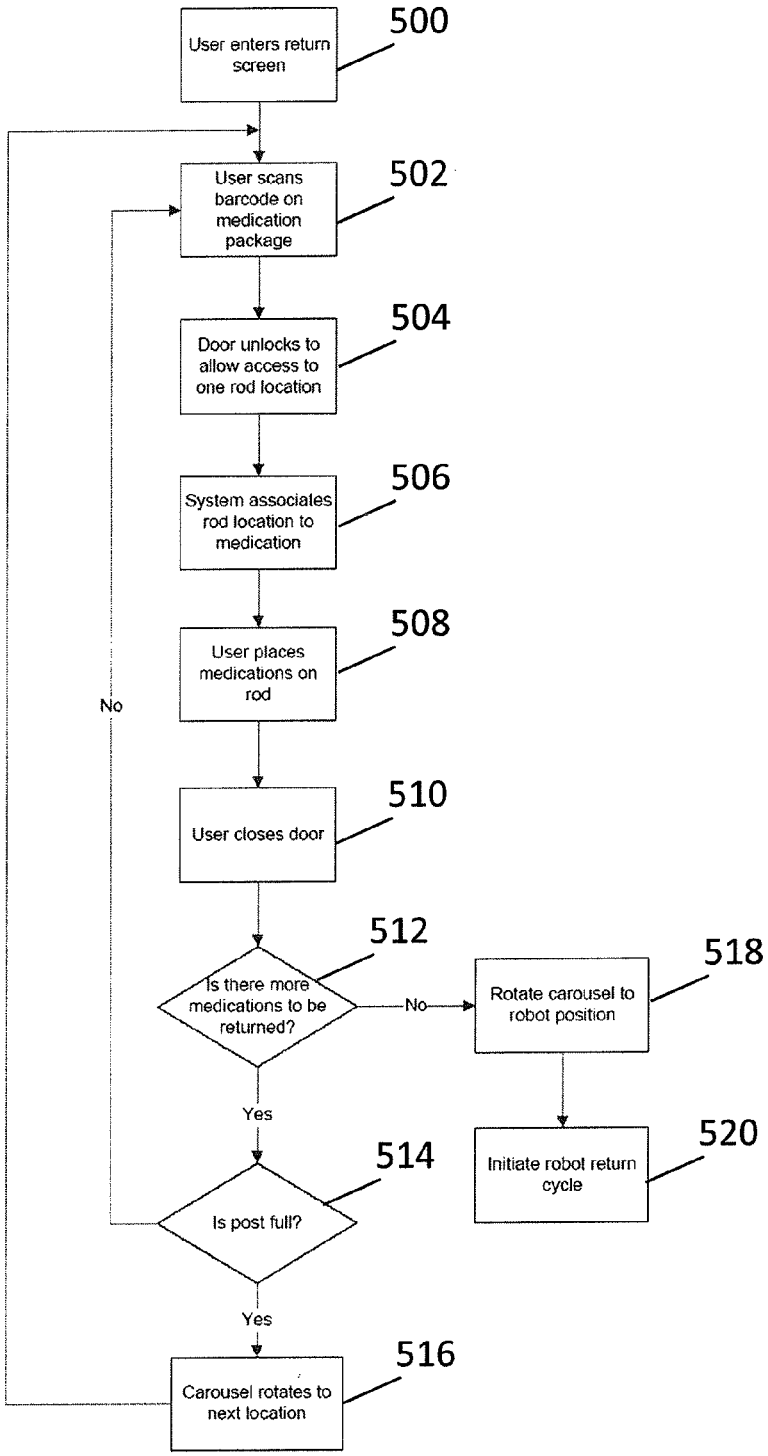
FIG. 6 is a flowchart of an article return process for an automated dispensing system according to an example embodiment of the present invention.

FIG. 6 is a flowchart of an example embodiment of a return process according to the present invention. An operator may use the screen 360 of the unload station illustrated in FIG. 4 to view a return screen at 500. The operator may then scan a barcode on the medication at 502. A door corresponding to an empty carrier may be unlocked at 504. The controller may then associate this carrier with the scanned medication at 506 as the operator loads the carrier with the scanned medication at 508. The operator may then close the door at 510. If there are more medications to be returned, an operator may indicate this at 512. If the carrier holder is full at 514, the carousel may rotate to the next available carrier holder at 516. If the carrier holder is not full at 514, the next available carrier may be used for the next medication to be returned. If there are no more medications to be returned at 512, the carrier holder of the carousel may be rotated to the load position where the robot may access the carrier holder at 518. The robot may then being a return cycle at 520 where the robot returns the medication to the appropriate storage location through a reversal of the medication retrieval process described above.

First doses of medication, or doses of medication which are new to a patient, may require special attention. Unique carriers or carrier holder may be designated for receiving first doses in order to alert the operator that the medication on the unique carrier or carrier holder is a first dose, and should be treated accordingly with the appropriate care and consideration of the pharmacists, nurses, and doctors involved. The unique carriers or carrier holders could be identified by color coding or some other means that would alert the operator that the medication contained on these unique carriers or carrier holders are first doses. If a first dose of a medication was encountered in a medication order during the fill operation for a patient, the robot may complete the medication order without the first dose and subsequently retrieve one of the unique carrier holders on which to place the first dose for that patient. Alternatively or additionally, the automated dispensing system may include flags that may be placed on a carrier adjacent to a medication on the carrier to indicate that it is a first dose. For example, during the medication order fill, if a medication was determined to be a first dose, after loading the medication on the carrier, the robot may load a first dose flag onto the carrier indicating to the operator that the dose behind that flag is a first dose and should be handled accordingly.

The above described embodiments may rely upon the controller to assign a patient to a carrier position on a carrier holder, and subsequently display the patient's name or other identifying indicia on a screen when that carrier is unloaded at the unload station. A higher level of identification may be desired to further reduce the potential for erroneous medication distribution after dispensing from the automated dispensing system.

Figure 7:
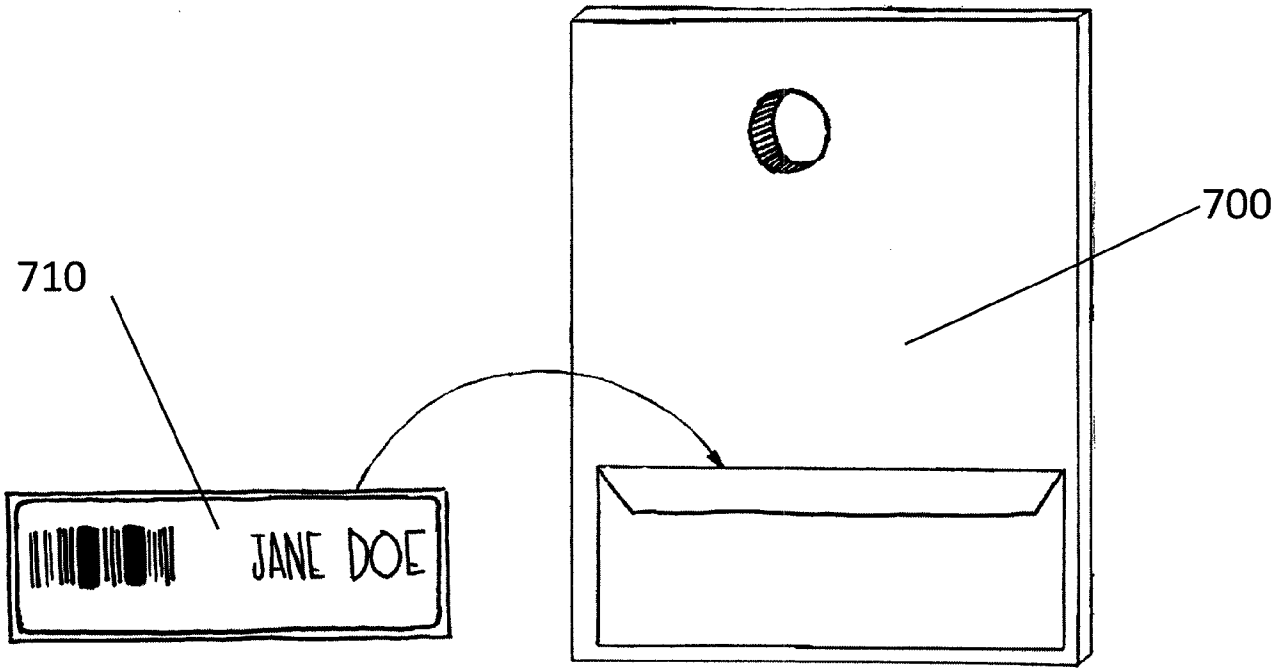
FIG. 7 illustrates a patient identification card according to an example embodiment of the present invention.
Figure 8:
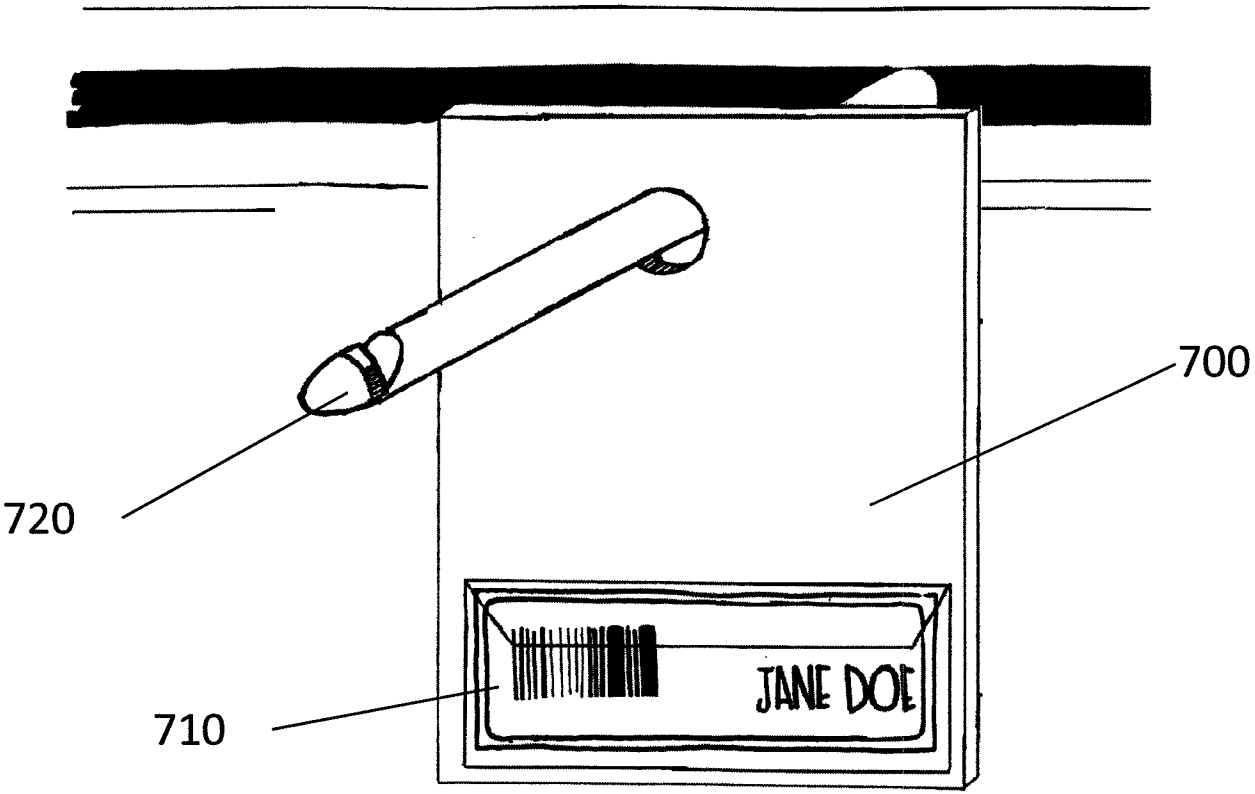
FIG. 8 illustrates a patient identification card loaded onto a carrier of a carrier holder of an automated dispensing system according to an example embodiment of the present invention.
Figure 9:
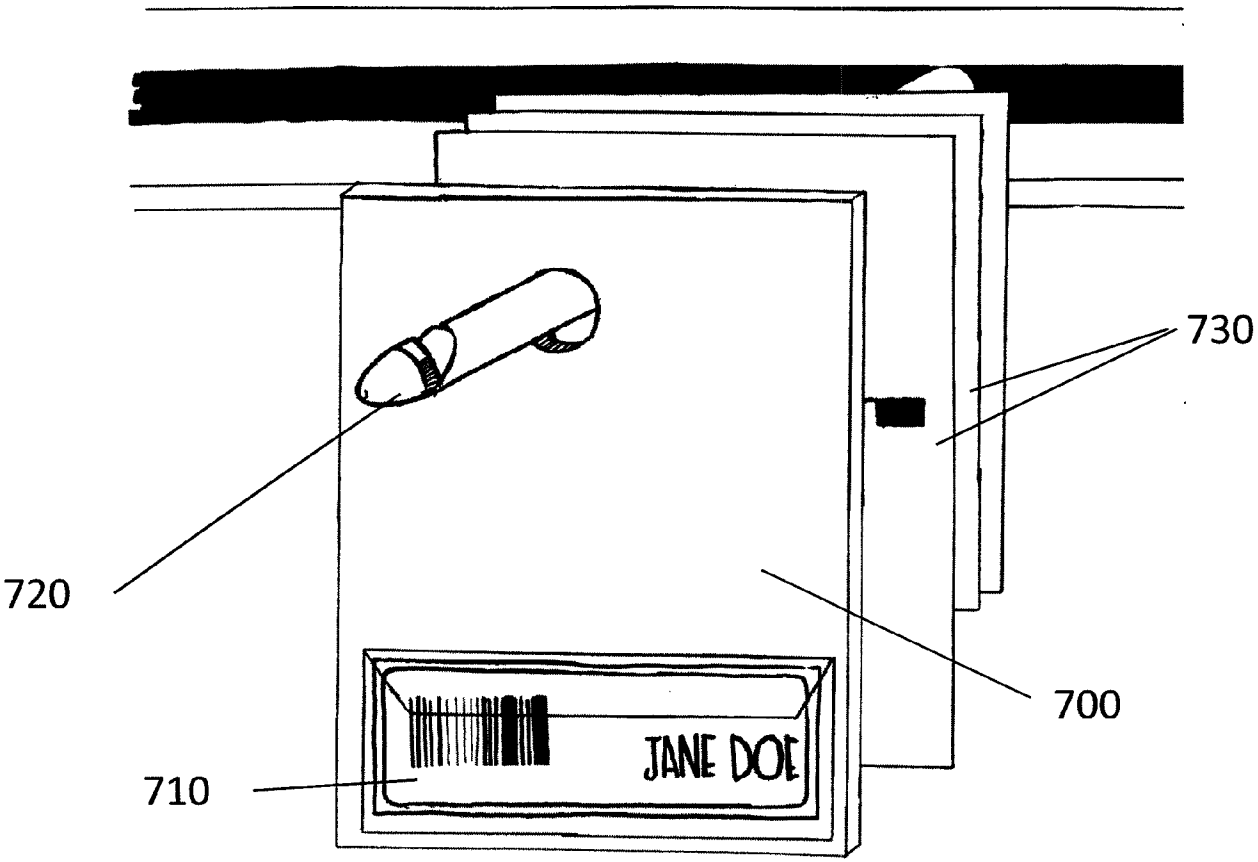
FIG. 9 illustrates a patient identification card loaded onto a carrier that has been loaded with articles according to an example embodiment of the present invention.
Figure 10:
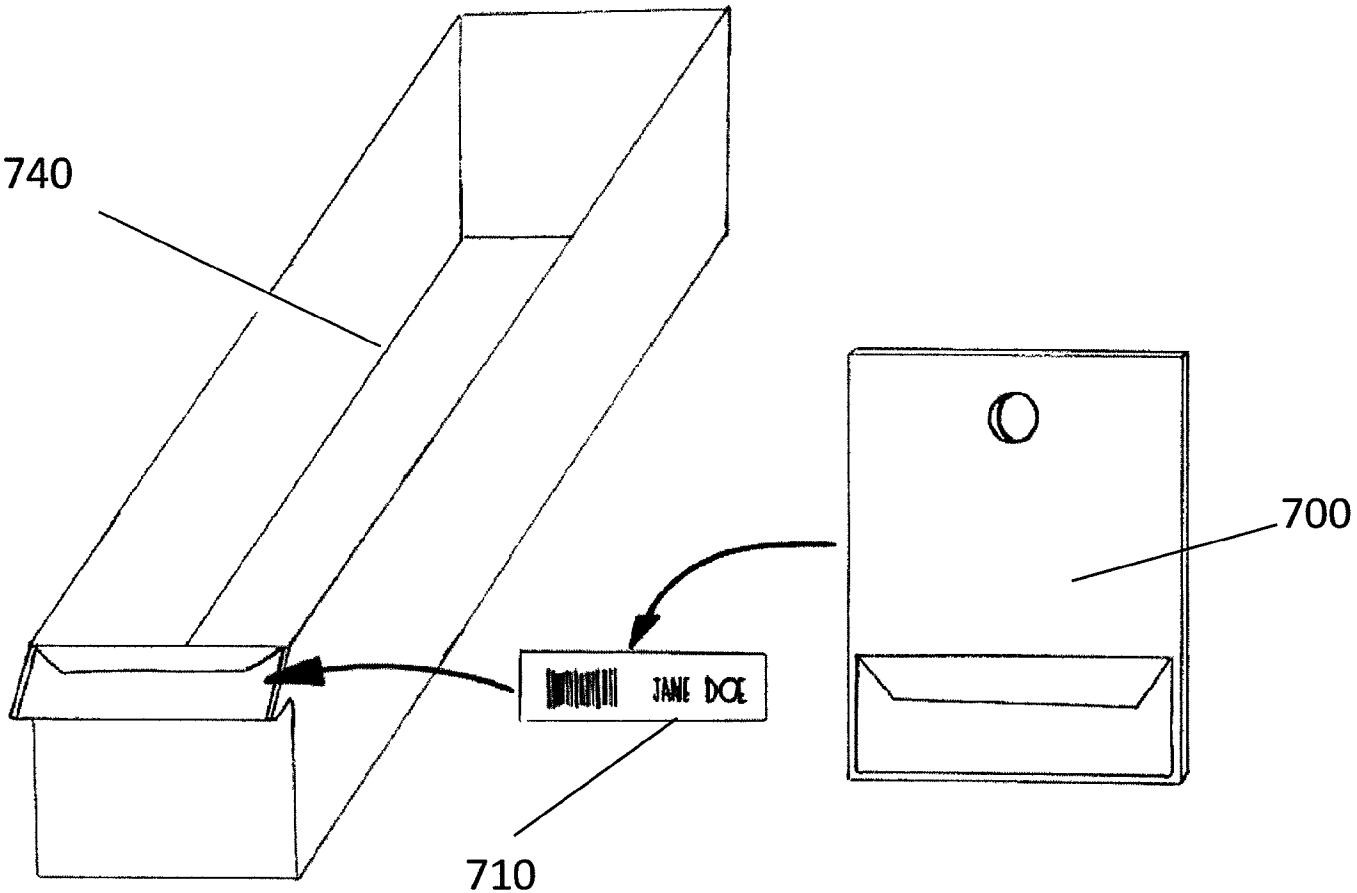
FIG. 10 illustrates a container for receiving articles dispensed from an automated dispensing system according to an example embodiment of the present invention.

Example embodiments of enhanced patient identification may include an embodiment wherein patient labels are printed for each individual patient before medication orders are filled. The patient labels may be inserted into or affixed to patient cards that are configured for placement on an empty carrier of a carousel before medication orders are filled. FIG. 7 illustrates an example patient card 700 with a patient label 710. The patient label may include a barcode or other indicia identifying the patient and the patient label may be inserted into a pocket of the patient card 700 or otherwise affixed to the patient card. A carousel may be filled with patient cards 700 identifying patients for each carrier 720 that is to be filled as illustrated in FIG. 8. During the medication order filling process, the robot of the automated dispensing system may remove a carrier holder from the carousel, remove the patient card from a carrier and scan the card to identify the patient assigned to that carrier. As illustrated in FIG. 9, the medication 730 may then be loaded onto the carrier 720 followed by the patient card 700. Once all of the carriers of a carrier holder are filled, the carrier holder may be returned to the carousel for subsequent unloading. In such an embodiment, when the operator unloads a carrier, they are presented with the patient card 700 first identifying the patient for which the medication is intended. The operator may then confirm the patient name with the screen of the unload station and the printed label. This process may provide an added level of verification to ensure that patient medications are directed to the appropriate patient. Optionally, rather than printing a new label for the patient for the container into which the medication will be unloaded, the patient label 710 may be removed from the patient card 700 and placed on the container 740 for identification of the patient for which the container is intended as illustrated in FIG. 10.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A system for dispensing articles, comprising:

a carousel comprising a plurality of stations;

a plurality of carrier holders, each configured to be received at a respective station; and a robot configured to retrieve a carrier holder from the carousel, move the carrier holder proximate a location of a first article, load the first article onto the carrier holder, and return the carrier holder to a station of the carousel;

wherein the robot is further configured to:

retrieve the first article from a first location to a carrier of the carrier holder;

retrieve a second article from a second location to a carrier of the carrier holder;

move the carrier holder including the first article and the second article to a position proximate the carousel;

transfer the first article from the carrier of the first article to one of a plurality of carriers configured for receiving articles; and transfer the second article from the carrier of the second article to another of the plurality carriers configured for receiving articles.

2. The system of claim 1, wherein each of the plurality of carrier holders comprises a plurality of carriers, wherein each carrier is configured to receive one or more articles.

3. The system of claim 2, wherein the articles comprise medications and each of the plurality of carriers is assigned to a patient.

4. The system of claim 3, wherein each of the plurality of carriers is assigned to a time of day for said patient.

5. The system of claim 3, wherein each of the plurality of carriers is configured to receive a patient identifier.

6. The system of claim 5, wherein the patient identifier identifying the patient is loaded onto each respective carrier.

7. The system of claim 6, wherein articles loaded onto each respective carrier are dispensed to a container, and wherein the patient identifier is dispensed to the container for identifying the patient to which the container is assigned.

8. The system of claim 2, wherein the robot is configured to load at least two of the plurality of carriers with the first article.

9. The system of claim 1, further comprising an unload station, wherein the carousel is configured to rotate a station into alignment with the unload station for manual unloading of the carrier holder at the unload station.

10. The system of claim 9, wherein the unload station comprises a plurality of doors and wherein each of said doors is configured to align with, and provide access to, a respective carrier of the carrier holder at the station.

11. The system of claim 1, further comprising an unload station arranged proximate the carousel, wherein the unload station comprises a door for each of the respective plurality of carriers configured for receiving articles, and wherein the carousel rotates to align each respective carrier holder with the unload station.

12. The system of claim 1, further comprising a controller configured to receive an order for the first article, wherein the controller is configured to direct the robot to the location of the first article.

13. A system for dispensing articles comprising:

a carousel comprising a plurality of stations;

a plurality of carrier holders, each carrier holder configured to be received at a respective station of the carousel;

a controller configured to receive an order for a first article and a second article; and a robot configured to retrieve a carrier holder from the carousel, move the carrier holder proximate a location of the first article, load the first article onto the carrier holder, move the carrier holder proximate a location of the second article, load the second article onto the carrier holder, and return the carrier holder to a station of the carousel.

14. The system of claim 13, wherein the controller is configured to receive a plurality of orders, and wherein the controller is configured to group together orders for a particular patient for loading to a single carrier holder.

15. The system of claim 13, wherein each of the plurality of carrier holders comprises a plurality of carriers, wherein each carrier is configured to receive one or more articles.

16. The system of claim 15, wherein the articles comprise medications and each of the plurality of carriers is assigned to a patient.

17. The system of claim 16, wherein each of the plurality of carriers is assigned to a time of day for said patient.

18. The system of claim 16, wherein each of the plurality of carriers is configured to receive a patient identifier.

19. The system of claim 13, further comprising an unload station, wherein the carousel is configured to rotate a station into alignment with the unload station for manual unloading of the carrier holder at the unload station.

20. The system of claim 19, wherein the unload station comprises a plurality of doors and wherein each of said doors is configured to align with, and provide access to, a respective carrier of the carrier holder at the station.

* * * * *